US010073489B2

(12) United States Patent
Wuisan et al.

(10) Patent No.: US 10,073,489 B2
(45) Date of Patent: Sep. 11, 2018

(54) ROLLING RETURN TO NEUTRAL DEPRESSABLE CONTROL

(71) Applicant: Deere & Company, Moline, IL (US)

(72) Inventors: Giovanni A. Wuisan, Epworth, IA (US); Ronald J. Huber, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 360 days.

(21) Appl. No.: 14/860,129

(22) Filed: Sep. 21, 2015

(65) Prior Publication Data

US 2017/0083039 A1 Mar. 23, 2017

(51) Int. Cl.

| | |
|---|---|
| ***G05G 9/047*** | (2006.01) |
| ***G05G 5/05*** | (2006.01) |
| ***G05G 5/04*** | (2006.01) |

(52) U.S. Cl.

CPC ..... *G05G 9/047* (2013.01); *G05G 5/04* (2013.01); *G05G 5/05* (2013.01); *G05G 2009/04711* (2013.01); *G05G 2009/04755* (2013.01); *G05G 2009/04777* (2013.01)

(58) Field of Classification Search

CPC ..... G05G 9/047; G05G 5/04; G05G 5/05; G05G 2009/04711; G05G 2009/04777; G05G 2009/04755; G05G 2009/04774

See application file for complete search history.

(56) References Cited

U.S. PATENT DOCUMENTS

| | | | | |
|---|---|---|---|---|
| 4,543,515 | A * | 9/1985 | Suzuki | H02P 1/22 200/12 |
| 5,432,530 | A * | 7/1995 | Arita | G05G 1/06 345/159 |
| 6,266,046 | B1 * | 7/2001 | Arita | G05G 9/047 345/156 |
| 6,606,085 | B1 * | 8/2003 | Endo | G05G 9/04796 345/159 |
| 6,738,043 | B2 * | 5/2004 | Endo | G06F 3/0338 324/207.13 |
| 7,283,124 | B2 | 10/2007 | Pai | |
| 8,283,583 | B2 * | 10/2012 | Asada | H01H 25/06 200/4 |
| 8,345,005 | B2 * | 1/2013 | Jaouen | G05G 9/047 345/156 |

(Continued)

OTHER PUBLICATIONS

'Photograph of switch invention'. Wuisan, Giovanni A., Engineer, Deere & Company, Duqubue, IA, US, Oct. 31, 2014.

(Continued)

*Primary Examiner* — Victor L MacArthur

(57) ABSTRACT

A user actuated control which may include a base, roller, magnet, sensor and spring assembly. The roller may be movably connected to the base so as to allow rotational displacement between a neutral angle and a maximum angle and linear displacement between a neutral position and a depressed position. The magnet may be connected to the roller and the sensor may be connected to the base. The sensor may be configured to measure both the orientation and intensity of a magnetic field produced by the magnet and passing through the sensor. The spring assembly may be connected to the roller and the base and configured to exert a torque on the roller tending to return it to the neutral angle and the neutral position.

11 Claims, 5 Drawing Sheets

(56) References Cited

U.S. PATENT DOCUMENTS

| | | | | |
|---|---|---|---|---|
| 8,350,811 | B2 | 1/2013 | Jensen | |
| 8,754,910 | B2 | 6/2014 | O'Sullivan et al. | |
| 9,037,355 | B2 | 5/2015 | Scheer | |
| 9,423,894 | B2 * | 8/2016 | Olsson | G05G 9/047 |
| 2004/0003985 | A1 * | 1/2004 | Nishimoto | G05G 9/04792 200/6 A |

OTHER PUBLICATIONS

Photograph of Analog Thumb Joystick with Switch [retrieved on Dec. 16, 2014] http://skpang.co.uk/catalog/analog-thumb-joystick-with-switch-p-420.html.

* cited by examiner

ROLLING RETURN TO NEUTRAL DEPRESSABLE CONTROL

FIELD OF THE DISCLOSURE

The present disclosure relates to a machine. An embodiment of the present disclosure relates to a control which may be rotated or depressed and which returns to a neutral angle and position.

BACKGROUND

Controls may be provided for input by a user. One type of control may be designed to be actuated by a user's finger in a rotational motion. This type of user actuated control may also be referred to as a finger control, fingertip control, rocker, thumbwheel, or wheel.

SUMMARY

According to an aspect of the present disclosure, a user actuated control may include a base, a roller, a magnet, a sensor, and a spring assembly. The roller may be movably connected to the base so as to allow rotational displacement between a neutral angle and a maximum angle and linear displacement between a neutral position and a depressed position. The magnet may be connected to the roller and positioned to rotate with rotational displacement of the roller. The magnet may be positioned to linearly displace with linear displacement of the roller. The sensor may be connected to the base and configured to measure both the orientation and intensity of a magnetic field produced by the magnet and passing through the sensor. The spring assembly may be connected to the roller and the base and configured to exert a torque on the roller in the direction of the neutral angle when the roller is rotationally displaced from the neutral angle. The spring assembly may also be configured to exert a force on the roller in the direction of the neutral position when the roller is linearly displaced from the neutral position.

According to another aspect of the present disclosures, the roller may be movably connected to the base so as to allow rotational displacement between a minimum angle and the neutral angle, the neutral angle positioned between the minimum angle and the maximum angle.

According to another aspect of the present disclosures, the roller may be movably connected to the base so as to allow continuous rotational displacement between the minimum angle and the maximum angle.

According to another aspect of the present disclosures, the sensor may be configured to provide a rotation signal indicative of the rotational displacement of the roller based on the measured orientation of the magnetic field and to provide a linear signal indicative of the linear displacement of the roller based on the measured intensity of the magnetic field.

According to another aspect of the present disclosures, the sensor may be a Hall Effect sensor.

According to another aspect of the present disclosures, the shield may be positioned under the roller and configured to allow linear displacement of the roller to the depressed position when the roller is at the neutral angle. The shield may be configured to block linear displacement of the roller to the depressed position at a first angle of the roller. The shield may be configured to block linear displacement of the roller to the depressed position at a second angle of the roller. The first angle is between the maximum angle and the neutral angle and the second angle is between the neutral angle and the minimum angle.

According to another aspect of the present disclosures, the shield may be configured to allow linear displacement of the roller to the depressed position when the roller is at the maximum angle. The shield may be configured to allow linear displacement of the roller to the depressed position when the roller is at the minimum angle.

According to another aspect of the present disclosures, the shield may be configured to block linear displacement of the roller to the depressed position when the roller is at the maximum angle and the shield is configured to block linear displacement of the roller to the depressed position when the roller is at the minimum angle.

According to another aspect of the present disclosures, a user actuated control may include a base, a roller, a top stop, a bottom stop, a front stop, a rear stop, a magnet, a sensor, and a spring assembly. The roller may be positioned above the base and pivotally and slidably connected to the base about a pin disposed in a slot having a slot length. The top stop may be positioned to block further linear displacement of the roller in a first linear direction when the roller is at a neutral position. The bottom stop may be positioned to block further linear displacement of the roller in a second linear direction opposite the first linear direction when the roller is at a depressed position. The front stop may be positioned to block further rotational displacement of the roller in a first rotational direction when the roller is at a maximum angle. The rear stop may be positioned to block further rotational displacement of the roller in a second rotational direction opposite the first rotational direction when the roller is at a minimum angle. The magnet may be connected to the roller and positioned to rotate with rotational displacement of the roller and linearly displace with linear displacement of the roller. The sensor may be connected to the base and configured to measure both the orientation and intensity of a magnetic field produced by the magnet and passing through the sensor. The spring assembly may be connected to the roller and the base and positioned to exert force on the roller in the first linear direction when the roller is at the depressed position, torque on the roller in the first rotational direction when the roller at the minimum angle, and torque on the roller in the second rotational direction when the roller is at the maximum angle.

According to another aspect of the present disclosures, the top stop may be a portion of the slot at a first end of the slot in the direction of the slot length where the pin contacts the slot when the roller is at the neutral position. The bottom stop is a portion of the slot at a second end of the slot opposite the first end of the slot in the direction of the slot length where the pin contacts the slot when the roller is at the depressed position.

According to another aspect of the present disclosures, the top stop may be a portion of the slot at an end of the slot in the direction of the slot length where the pin contacts the slot when the roller is at the neutral position. The bottom stop may be a portion of the base which contacts the roller when the roller is at the depressed position.

According to another aspect of the present disclosures, the spring assembly may be positioned to exert a first force on the roller in the first linear direction when the roller is at the depressed position. The spring assembly may be positioned to exert the equivalent of a second force on a surface of the roller tangent to the surface in the first rotational direction when the roller is at the minimum angle. The spring assembly may be positioned to exert the equivalent of a third force on the surface of the roller tangent to the surface in the second rotational direction when the roller is at the maximum angle. The magnitude of the first force may be greater than the magnitude of the second force and greater than the magnitude of the third force.

According to another aspect of the present disclosures, the shield may be positioned between the base and the roller. The shield may include a hole, the roller may include a protrusion, and the protrusion may be positioned within the hole when the roller is at the depressed position and the neutral angle.

According to another aspect of the present disclosures, the shield may be positioned between the base and the roller. The shield may include a first hole, a second hole, and a third hole. The roller may include comprises a protrusion positioned within the first hole when the roller is at the depressed position and the neutral angle and positioned within the second hole when the roller is at the depressed position and the maximum angle. The protrusion may be positioned within the third hole when the roller is at the depressed position and the minimum angle.

According to another aspect of the present disclosures, the sensor may be configured to provide a rotation signal indicative of the rotational displacement of the roller based on the measured orientation of the magnetic field and provide a displacement signal indicative of the linear displacement of the roller based on the measured intensity of the magnetic field.

According to another aspect of the present disclosures, the displacement signal may be binary such that it indicates the roller is not depressed unless the measured intensity of the magnetic field is greater than a threshold, in which case it indicates that the roller is depressed.

According to another aspect of the present disclosures, a user actuated control may include a base, a roller, a housing, a magnet, a sensor, and a spring assembly. The housing may be pivotally connected to one of the base and the roller and slidingly connected to the other of the base and the roller so as to allow rotational displacement of the roller relative to the base from a minimum angle to a maximum angle and linear displacement of the roller relative to the base from a neutral position to a depressed position. The magnet may be connected to the roller and positioned to rotate with rotational displacement of the roller and linearly displace with linear displacement of the roller. The sensor may be connected to the base and configured to measure both the orientation and intensity of a magnetic field produced by the magnet and passing through the sensor. The spring assembly may be connected to the roller and the base and positioned to exert force on the roller in the first linear direction when the roller is at the depressed position, torque on the roller in the first rotational direction when the roller at the minimum angle, and torque on the roller in the second rotational direction when the roller is at the maximum angle.

According to another aspect of the present disclosures, the spring assembly may be positioned to exert a first force on the roller in the first linear direction when the roller is at the depressed position, the equivalent of a second force on a surface of the roller tangent to the surface in the first rotational direction when the roller is at the minimum angle, and the equivalent of a third force on the surface of the roller tangent to the surface in the second rotational direction when the roller is at the maximum angle. The magnitude of the first force may be greater than the magnitude of the second force and greater than the magnitude of the third force.

According to another aspect of the present disclosures, the sensor may be a Hall Effect sensor configured to provide a rotation signal indicative of the rotational displacement of the roller based on the measured orientation of the magnetic field and a displacement signal indicative of the linear displacement of the roller based on the measured intensity of the magnetic field.

The above and other features will become apparent from the following description and accompanying drawings.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

Figure 1:
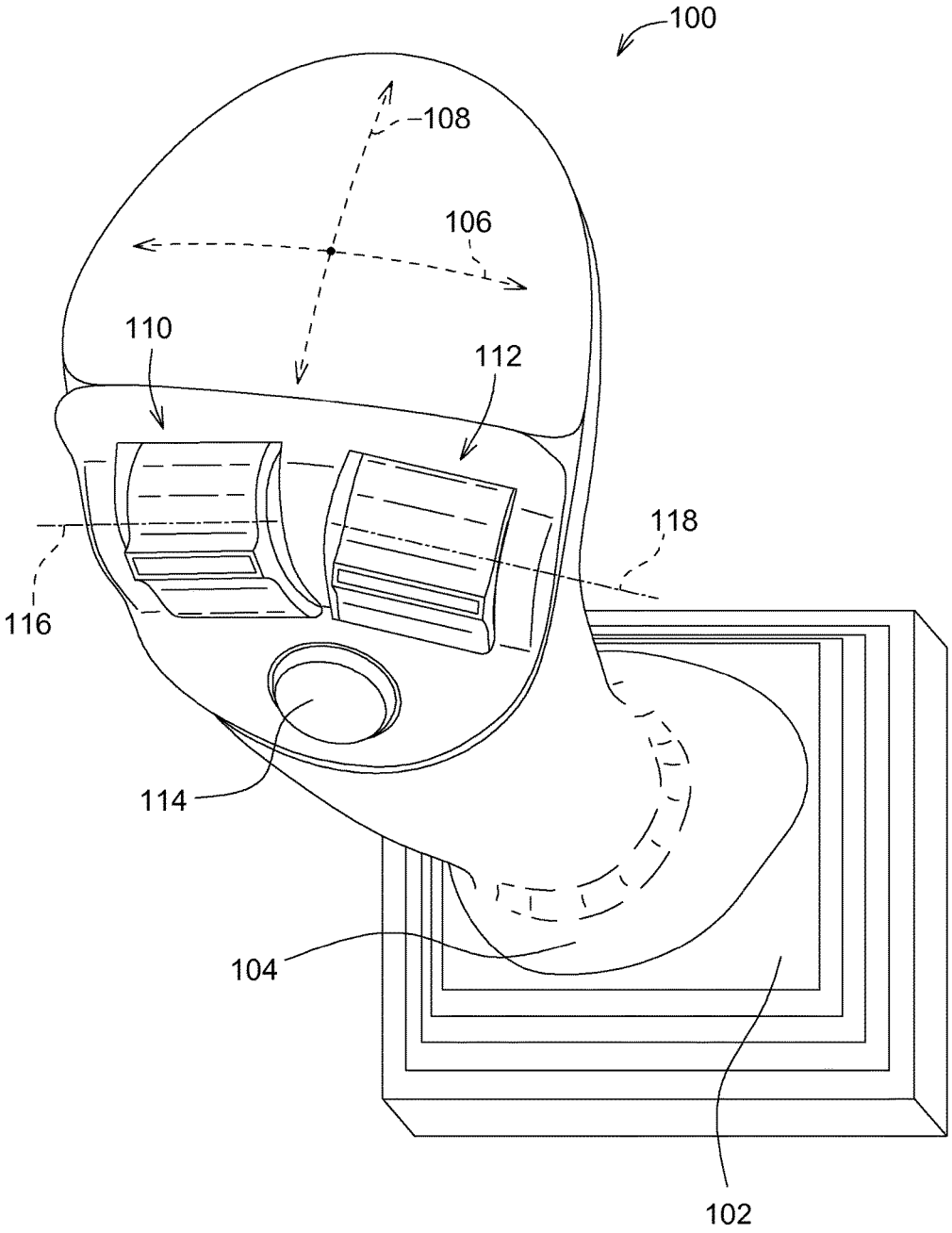
FIG. 1 is a perspective view of a user input device, in this case a joystick, including a first user control and a second user control.

FIG. 1 illustrates a user input device, joystick 100. The joystick 100 connects to a base 102 via a downward extending shaft 104, such that it may be rotated about both an x-axis 106 and a y-axis 108 relative to the base 102. This rotation may be measured by a sensor so as to translate the user's physical input into a command signal, for example to command movement of a machine. The joystick 100 may also include other controls which a user may actuate to send various command signals, such as a first user control 110, a second user control 112, and a button control 114. The button control 114 may be an on/off switch which sends a first signal when it is not being depressed by the user (which may be an open circuit signal or no voltage) and sends a second signal when it is being depressed by the user (which may be a closed circuit signal or voltage).

The first user control 110 has two degrees of freedom along which the user may actuate it to send command signals. For the first degree of freedom, the user may rotate the first user control 110 about a first axis 116 from a neutral angle, as shown in FIG. 1, upwards/forwards to a maximum angle, or downwards/backwards to a minimum angle. This first degree of freedom may also be referred to as roll, index, or rotational displacement. For the second degree of freedom, the user may depress the first user control 110 from a neutral position, as shown in FIG. 1, towards first axis 116 to a depressed position. This second degree of freedom may also be referred to as a depression, click, press, or linear displacement.

Similarly, the second user control 112 has two degrees of freedom along which the user may actuate it to send command signals. For the first degree of freedom, the user may rotate the second user control 112 about a second axis 118 from a neutral angle, as shown in FIG. 1, upwards/forwards to a maximum angle, or downwards/backwards to a minimum angle. For the second degree of freedom, the user may depress the first user control 110 from a neutral position, as shown in FIG. 1, towards second axis 118 to a depressed position. The first user control 110 and the second user control 112 may also be referred to as rollers, finger controls, fingertip controls, rockers, thumbwheels, or wheels.

The first user control 110 and the second user control 112 are both configured so that they may be rolled to any position between the maximum angle and the minimum angle, but not beyond those angles. This is achieved through the use of a first stop which is positioned to block further forward rotation of the controls when they reach the maximum angle and a second stop which is positioned to block further rearward rotation of the controls when the reach the minimum angle. Due to these stops, neither control may complete a revolution as may be possible in certain wheel-type controls.

The first user control 110 and the second user control 112 are also both configured with spring assemblies so that each returns to both the neutral angle and the neutral position when the user has ceased actuation. The neutral angle is the rotational displacement to which these spring assemblies will return the controls absent an external actuation force on the controls. The neutral position is the linear displacement to which these spring assemblies will return the controls absent an external actuation force on the controls. Due to this configuration, the spring assemblies will tend to resist actuation of the first user control 110 and the second user control 112 away from the neutral angle and neutral position. The force with which the spring assemblies resist actuation may be tuned through the design and selection of materials for the spring assemblies to achieve a desired feel for the controls.

FIGS. 2*a*-2*d* provide a side view of the first user control 110 with portions of the control removed to allow for better visibility of the components. Positioned at the top of the first user control 110 is a cap 120, which may also be referred to as a roller, which provides a surface 122 which the user may engage with a finger to actuate the first user control 110. The surface 122 may be patterned, textured, or shaped to provide greater traction, control, or comfort to the user when actuating the first user control 110. For example, a ridge 124 may be provided on cap 120 or integrally formed with cap 120 to provide traction to the user's finger as well as both visual and tactile feedback regarding the center or neutral angle of the cap 120.

The cap 120 is both pivotally and slidingly connected to a base 126 of the first user control 110 via the pins 128 and the slots 130 on first and second sides of the first user control 110. The cap 120 may rotate about the pins 128 and first axis 116 relative to the base 126. The cap 120 may also be linearly displaced towards the base 126 via the pins 128 sliding downwards within the slots 130. The first user control 110 utilizes a pair of coaxial pins disposed within a pair of slots, but in alternative embodiments this could be a single pin disposed in two slots or a single pin disposed in a single slot. The pins 128 of the first user control 110 are disposed on the cap 120, and the slots 130 are disposed on the base 126, but in alternative embodiments these could be reversed so that the pins 128 are disposed on the base 126 and the slots 130 are disposed on the cap 120.

As the pins 128 move upwards in the slots 130, they eventually contact the top of the slots 130 which prevents further upward motion of the pins 128 and therefore prevents further upward motion of the cap 120. This portion of the slots 130 may be referred to as a top stop. Similarly, as the pins 128 move downwards in the slots 130, they eventually contact the bottom of the slots 130 which prevents further downward motion of the pins 128 and therefore prevents further downward motion of the cap 120. This portion of the slots 130 may be referred to as a bottom stop.

Sensor 132 is mounted on the base 126 and positioned below the cap 120. Sensor 132 is capable of measuring both the direction and intensity of a magnetic field passing through it. To name a few examples, sensor 132 may be a Hall Effect sensor, a magnetoresistive sensor, or some combination thereof. Sensor 132 is configured to provide a signal or signals indicative of both the direction and intensity of the magnetic field via a wiring harness connecting it to a controller. In alternative embodiments, sensor 132 may include a controller which can generate CAN (controller area network) messages or a message with another protocol which are indicative of the direction or intensity of the magnetic field passing through it, and communicate these to a remote controller.

Sensor 132 is positioned across an air gap from magnet 134, which is mounted on the plunger 131. Magnet 134 is a magnetic material that produces the magnetic field which passes through, and is measured by, sensor 132. Magnet 134 is mounted to the cap 120 so as to move with the cap 120, both in terms of rotation (i.e., from the minimum angle to the maximum angle of cap 120) and linear displacement (e.g., from the neutral position to the depressed position of cap 120). In alternative embodiments, magnet 134 may not be mounted on cap 120, but may instead be mounted to an intermediate component connected to the cap 120 so as to maintain a fixed relative position to the cap 120. Such an alternative arrangement still allows movement of the cap 120 to be reflected in movement of the magnet 134, allowing sensor 132 to sense the angle and intensity of the magnetic field generated by magnet 134.

The first user control 110 also includes a spring assembly 136. The spring assembly 136 includes a first spring 138 and a second spring 140. The first spring 138 is a compression spring which has one end connected to the cap 120 and the opposite end connected to the base 126, and is positioned such that it is under compression when the cap 120 is at the neutral angle. The second spring 140 is a compression spring which has one end connected to the cap 120 and the opposite end connected to the base 126, and is positioned such that it is under compression when the cap 120 is at the neutral angle. The first spring 138 and the second spring 140 are each located on opposite sides of first axis 116 such that their forces tend to cause opposing torques on first cap 120 but the forces both tend to move cap 120 towards the neutral position and away from the depressed position. As the cap 120 rotates from the neutral angle to the maximum angle, the compression of first spring 138 is increased as its connection point with the cap 120 is moved toward its connection point with the base 126, while the compression on second spring 140 is reduced as its connection point with cap 120 is moved away from its connection point with the base 126. Conversely, as the cap 120 rotates from the neutral angle to the minimum angle, the compression of first spring 138 is reduced as its connection point with the cap 120 is moved away from its connection point with the base 126, while the compression on second spring 140 is increased as its connection point with cap 120 is moved toward its connection point with the base 126. The opposing torques from the first spring 138 and the second spring 140 cancel each other out when the cap 120 is at the neutral angle, but become unbalanced when the cap 120 is rotated away from the neutral angle such that there is a net torque on the cap 120 tending to move the cap 120 in the direction of the neutral angle. This configuration tends to cause the cap 120 to return to center, the neutral angle, when it is rotationally displaced. Both the first spring 138 and the second spring 140 are compressed further as the cap 120 is linearly displaced from the neutral position to the depressed position, and therefore these two springs tend to cause the cap 120 to return to the neutral position when it is linearly displaced. In total, spring assembly 136 allows the first user control 110 to be used as a rolling control which returns to a center or neutral angle and position after rotational (i.e., angular or rolling input) or linear (i.e., click or press input) displacement.

In alternative embodiments, the spring assembly 136 may be configured differently, including with a different positioning, number, or style of springs (e.g., coil spring, elastomer button). As one example, an alternative embodiment could utilize one or more torsion springs and a tension/compression spring. The torsion spring or springs may be positioned with a first end extending across a portion of the cap 120 and a portion of the base 126 such that it engages whichever portion is closer to the neutral angle of the cap 120, and a second end extending across a portion of the cap 120 and a portion of the base 126 such that it engages whichever portion is closer to the neutral angle of the cap 120. The tension/compression spring may be positioned so that its first end is connected to the cap 120, its second end is connected to the base 126, and it is under either tension or compression causing it to exert a force on the cap 120 when cap 120 is linearly displaced from the first axis 116. This configuration causes the cap 120 to return to its neutral angle when released, as the torsion spring is compressed between the cap 120 on one end and the base 126 on the other end if the cap 120 is moved away from the neutral angle, and return to its neutral position when released, as the tension/compression spring exerts a constant force on the cap 120 in the direction of the neutral position. In all these configurations, the spring assembly may be composed of different materials, including metals and elastomers, to achieve the desired properties and features.

Figure 2A:
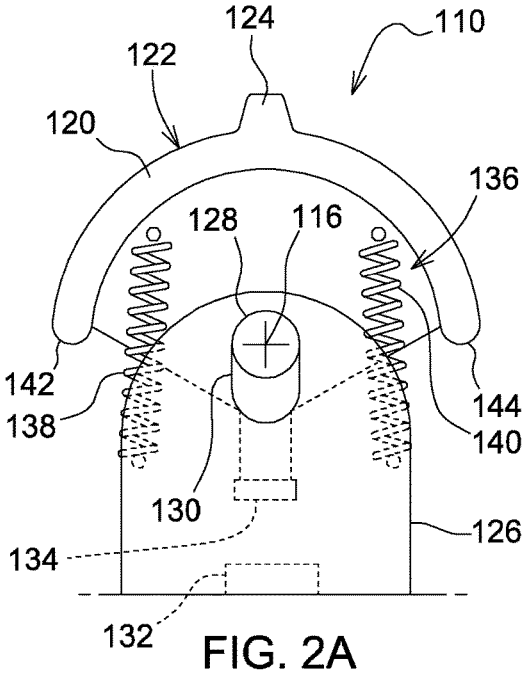
FIG. 2*a* is a side view of the first user control of FIG. 1 at a neutral angle and a neutral position.

FIG. 2*a* illustrates the first user control 110 with the cap 120 at the neutral angle and the neutral position. This may also be referred to as the center, relaxed, or unactuated state or position of the first user control 110.

Figure 2B:
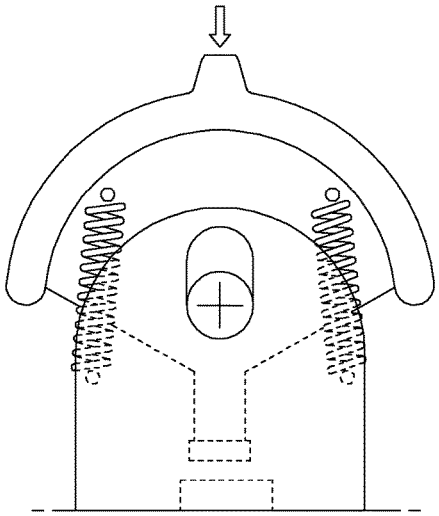
FIG. 2*b* is a side view of the first user control at the neutral angle and a depressed position.

FIG. 2*b* illustrates the first user control 110 with the cap 120 at the neutral angle and the depressed position. A user may actuate the first user control 110 by exerting a force on the surface 122 in the direction of the first axis 116, or opposite the direction of a normal of the surface 122, overcoming the resistance to such movement exerted by the first spring 138 and the second spring 140 of the spring assembly 136. This actuation may also be referred to as a press, click, or push of the first user control 110. Relative to base 126, the direction of the force necessary to depress the cap 120 may shift, as it depends on the rotational position of the cap 120.

Figure 2C:
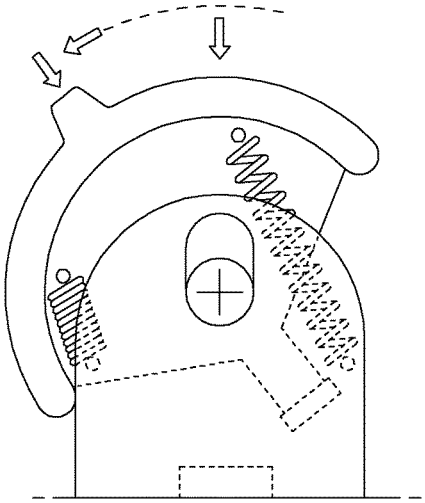
FIG. 2*c* is a side view of the first user control at a maximum angle and the depressed position.

FIG. 2*c* illustrates the first user control 110 with the cap 120 at an angle between the neutral angle and the minimum angle and the depressed position. A user may actuate the first user control 110 to the position illustrated in FIG. 2*c* by rotating the cap 120 about first axis 116 and then depressing the cap 120, which may be referred to as linearly displacing the cap 120, to the depressed position. A user may actuate the first user control 110 by placing a finger on the ridge 124 of the cap 120 and exerting force on one side of the ridge to produce a torque on the cap 120 that causes it to rotate. A user may also place a finger on the surface 122 of the cap 120 and rely on the fraction between the user's finger and the surface 122 to exert a torque on the cap 120.

The maximum angle of the first user control 110 may be limited by the first spring 138 and/or the first stop 142, which may also be referred to as a front stop. As the cap 120 reaches the maximum angle, the first spring 138 reaches its maximum compression and prevents further rotation of the cap 120. As the cap 120 reaches its maximum angle, the first stop 142 may be positioned so that it contacts the base 136, as shown in FIG. 2C, thereby preventing further rotational movement of the cap 120. Similarly, the minimum angle of the first user control 110 is reached when the second spring 140 reaches its maximum compression, and the second stop 144 (which may also be referred to as a rear stop) contacts the base 126, both of which prevent further rotation of the cap 120. The first spring 138, second spring 140, first stop 142, and second stop 144 each act as stops for the cap 120 for the first user control 110.

When the cap 120 is displaced from the neutral position, the application of force on the surface 122 by a user may actuate the cap 120 toward the depressed position but it may also generate a net torque on the cap 120 which may cause rotational displacement of the cap 120 relative to the base 126. A user may manually compensate for this torque in order to keep the cap 120 at the same rotational displacement, or may allow the cap 120 to rotate to some extent while linearly displacing the cap 120. The spring assembly 136 may be positioned and designed so as to carefully balance spring forces so as to enable a user to control both rotational and linear displacement as independently from each other as possible.

Figure 2D:
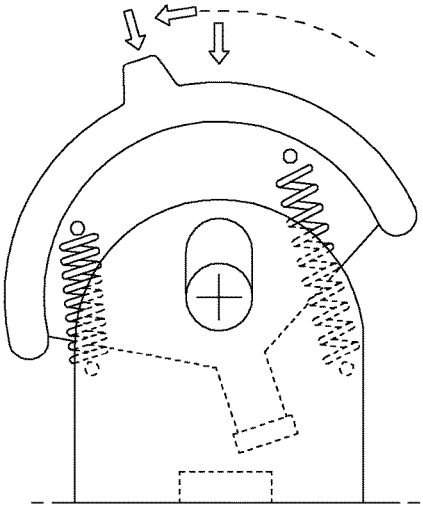
FIG. 2*d* is a side view of the first user control at an angle between the neutral angle and the maximum angle and the depressed position.

FIG. 2*d* illustrates the first user control 110 with the cap 120 at the minimum angle and the neutral position. As discussed above, the spring assembly 136 may be configured such that the user may actuate the cap 120 to the maximum or the minimum angle without causing linear displacement. As one example, the first spring 138 and the second spring 140 may each have spring constants and have their ends positioned such that the force exerted by the spring assembly 136 opposing linear displacement is greater than the net linear force caused by a user rotationally displacing cap 120. This arrangement allows the user to exert a force on the surface 122 or the ridge 124 which is sufficient to cause the cap 120 to rotate to its maximum or minimum angle, but which is less than the force required to depress the cap 120 from its neutral position.

Figure 3A:
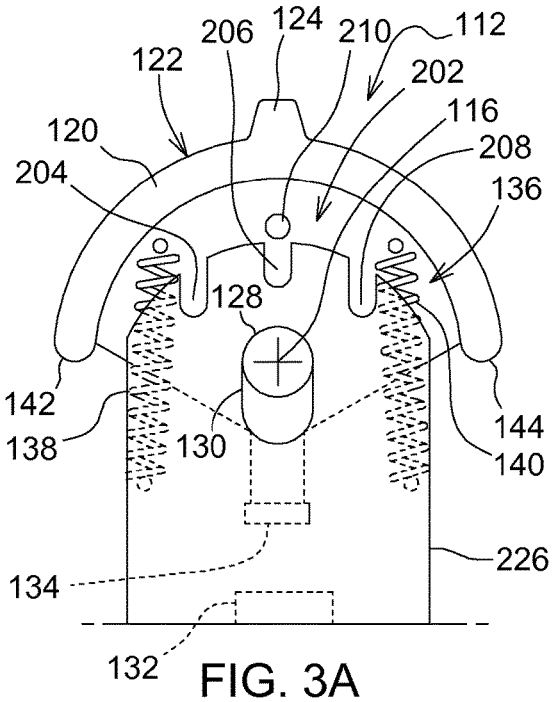
FIG. 3*a* is a side view of the second user control at a neutral angle and a neutral position.
Figure 3B:
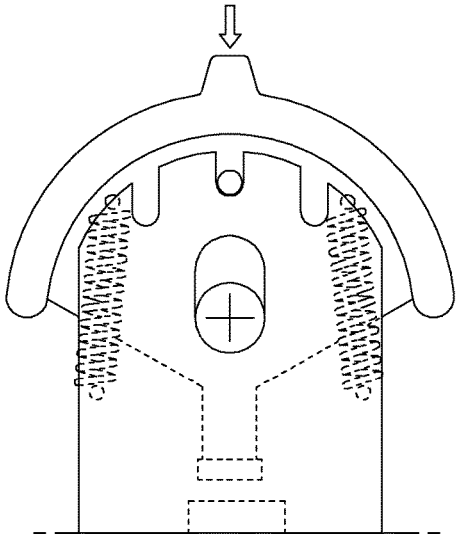
FIG. 3*b* is a side view of the second user control at the neutral angle and a depressed position.
Figure 3C:
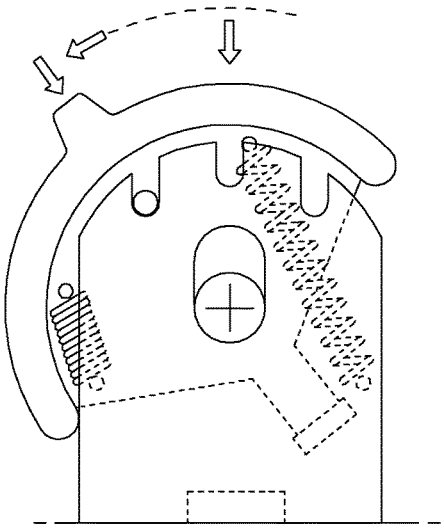
FIG. 3*c* is a side view of the second user control at a maximum angle and the depressed position.
Figure 3D:
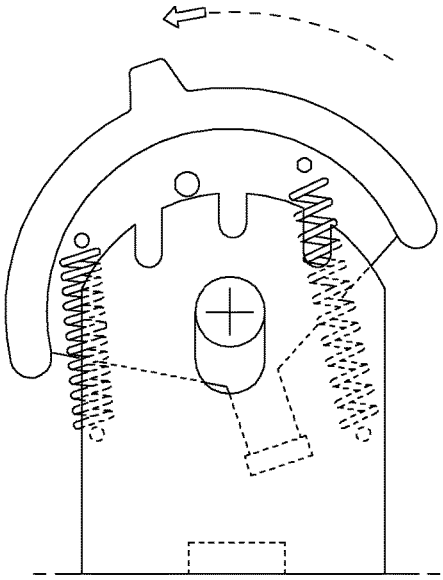
FIG. 3*d* is a side view of the second user control at an angle between the neutral angle and the maximum angle and the neutral position.
Figure 4A:
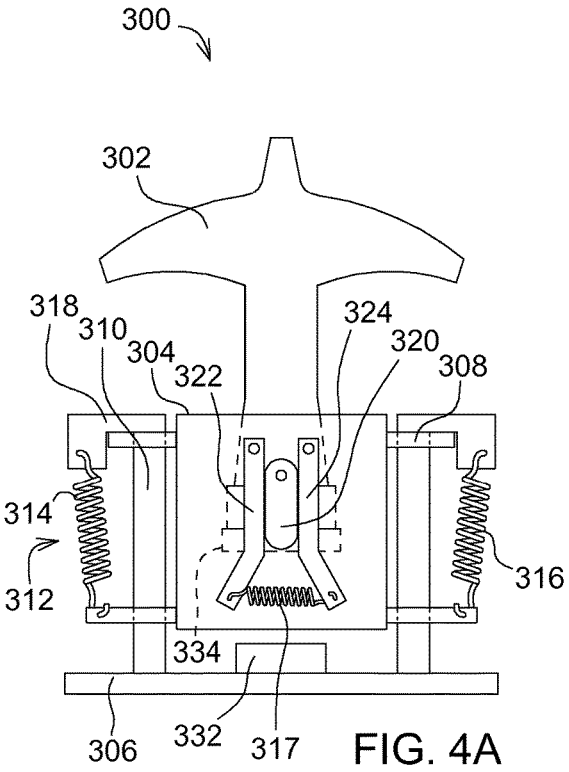
FIG. 4*a* is a side view of a third user control at a neutral angle and a neutral position.
Figure 4B:
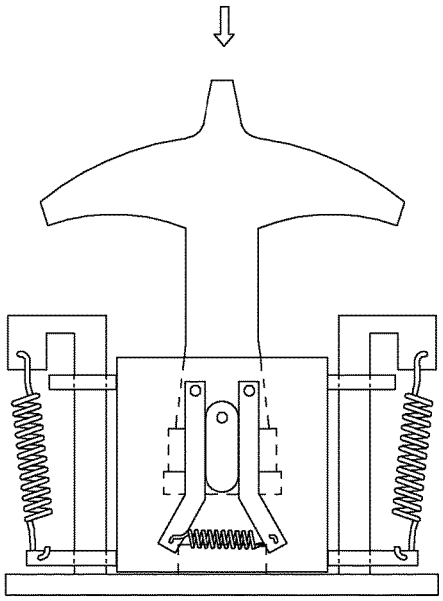
FIG. 4*b* is a side view of the third user control at the neutral angle and a depressed position.
Figure 4C:
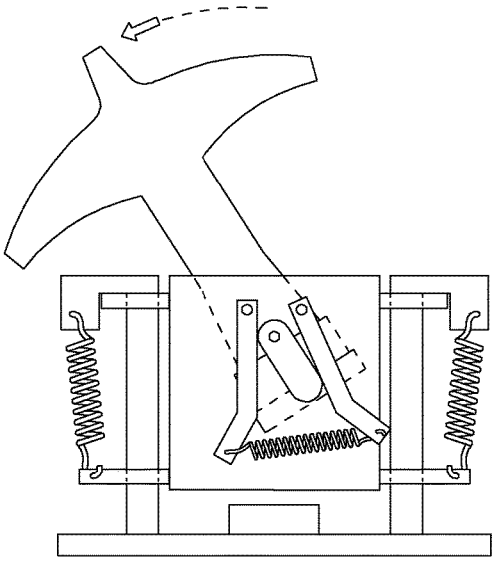
FIG. 4*c* is a side view of the third user control at a maximum angle and the neutral position.
Figure 4D:
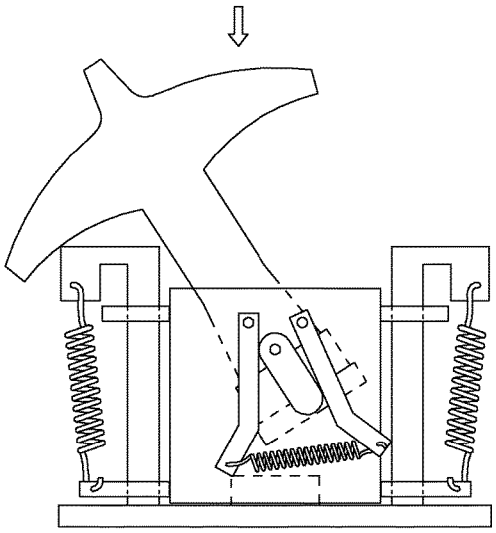
FIG. 4*d* is a side view of the third user control at the maximum angle and the depressed position.

FIGS. 3*a*-3*d* provide a side view of the second user control 112 with portions of the control removed to allow for better visibility of the components. Like reference numerals have been used to indicate like elements in FIGS. 2 and 3. Unlike with the user control 110, the base 226 of the user control 112 includes a shield 202 with a first slot 204, a second slot 206, and a third slot 208. In FIG. 3, the shield 202 is a top portion of the base 226 and is integral with the base 226, but in alternative embodiments the shield 202 may be a separate component. Similar to FIG. 2, FIG. 3*a* illustrates the second user control 112 at the neutral angle and neutral position, FIG. 3*b* illustrates the second user control 112 at the neutral angle and the depressed position, and FIG. 3*c* illustrates the second user control 112 at the maximum angle and the depressed position. FIG. 4*d*, however, illustrates the second user control 112 at an angle between the maximum angle and the neutral angle, and at the neutral position, illustrating that the shield 202 prevents linear actuation of the cap 120 except at the maximum, neutral, and minimum angles. Specifically, a pin 210 connected to the cap 120 is able to be linearly displaced into one of the first slop 204, second slot 206, or third slot 208 only when the cap 120 is at the maximum, neutral, or minimum angle. At other angles, the pin 210 contacts the shield 202 if the cap 120 is depressed and prevents linear displacement of the cap 120 to the depressed position. The shield 202 may be included in a user control for applications in which a user is only intended to use a "click" at certain angles of the roller and it is desired for the user to receive tactile feedback indicating these limited times it can be used. In alternative embodiments, the shield 202 and the pin 210 may not be included in the user control but instead a controller may be configured so as to ignore linear displacements except when the cap 120 is at one of the maximum, neutral, and minimum angles.

FIGS. 4*a*-4*d* illustrate an alternative user control, a third user control 300. The third user control 300 includes a cap 302, an intermediate base 304, and a base 306. The cap 302 is pivotally connected to the intermediate base 304, allowing the cap 302 to rotate relative to both the intermediate base 304 and the base 306. The intermediate base 304 is slidingly connected to the base 306 via tabs 308 disposed on the intermediate base 304 which receive posts 310 disposed on the base 306. This sliding connection enables the intermediate base 304, and the connected cap 302, to be linearly displaced relative to the base 306. A spring assembly 312, comprising a first spring 314, a second spring 316, and a third spring 317, biases the intermediate base 304 upwards relative to the base 306 until the tabs 308 contact the first stops 318 and prevent further upwards motion. This sliding connection with stops permits a user to depress the cap 302, a click or linear displacement, from the neutral position illustrated in FIG. 4*a* to the depressed position illustrated in FIG. 4*b*, and allows the cab 302 to return to the neutral position after external forces on it have ceased.

The cap 302 is pivotally connected to the intermediate base 304, and includes a protrusion 320 which is received between a first leg 322 and a second leg 324, each of which are pivotally connected to the intermediate base 304. The pivotal connections between the intermediate base 304 and the first leg 322 and second leg 324 are positioned relative to the pivotal connection of the cap 302 to the intermediate base 304 such that the rotation of the cap 302 causes rotational displacement of at least one of the first leg 322 and the second leg 324. FIG. 4*c* illustrates the cap 302 at the maximum angle, and the resulting rotational displacement of the cap 302 causes the protrusion 320 to rotate the second leg 324. Conversely, the rotation of the cap 302 to the minimum angle, or any angle less than the neutral angle, causes the protrusion 302 to rotate the first leg 322. As FIG. 4C illustrates, the end of the second leg 324 can act as a second stop as its contact with one of the posts 310 prevents further movement of the second leg 324, which in turn prevents further rotation of the protrusion 320 and the cap 302. The spring 317 is connected to an end of each of the first leg 322 and the second leg 324 and tends to bias those connection points towards each other. This bias, in turn, causes the first leg 322 and the second leg 324 to exert a force on the protrusion 320 which tends to move it and the connected cap 302 towards the neutral angle, and will tend to force the cap 302 to return from the maximum angle shown in FIG. 3*c* to the neutral angle shown in FIG. 3*a*.

A magnet 334 is fixedly connected to the bottom of the cap 302 so as to move with the cap 302. This magnet generates a magnetic field which passes through a sensor 332. The sensor 332 measures the orientation and intensity of the magnetic field, and provides a signal indicative thereof to a controller. Based on these signals, the controller can determine the linear displacement and rotational displacement of the cap 302 relative to the base 306, and utilize these displacement values as control inputs from a user.

FIGS. 5*a*-5*d* illustrate an alternative user control, a fourth user control 412, with portions of the control remove to allow for better visibility of the components. Like reference numerals have been used to indicate like elements in FIGS. 2, 3, and 5. Like with the user control 112, the user control 412 features the cap 120 which is may be rotatably or linearly displaced relative to the base 226. The shield 202 restricts linear displacement of the cap 120 to certain rotational displacements, specifically the rotational displacements of the cap 120 that place the pin 210 over one of the first slot 204, the second slot 206, and the third slot 208.

The fourth user control 412 departs from the design of the second user control 112 in the design and arrangement of its spring assembly 436. The spring assembly 436 includes a first spring 438 and a second spring 440. The first spring 438 is a compression spring with a first end connected to the pins 128 and a second end connected to a post 442 of the base 226. The second spring 440 is a torsion spring with coils 444 surrounding the pins 128, a first leg 446 extending from the coils 444 down to one side of the post 442 and the magnet 134, and a second leg 448 extending from the coils 444 down to the opposite side of the post 442 and the magnet 134.

Figure 5A:
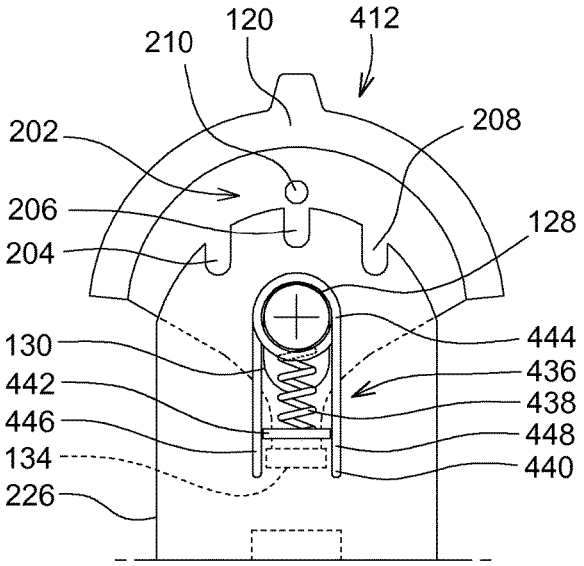
FIG. 5*a* is a side view of the fourth user control at a neutral angle and a neutral position.
Figure 5B:
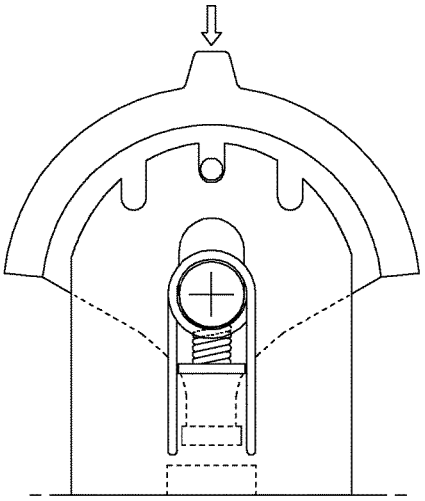
FIG. 5*b* is a side view of the second user control at the neutral angle and a depressed position.
Figure 5C:
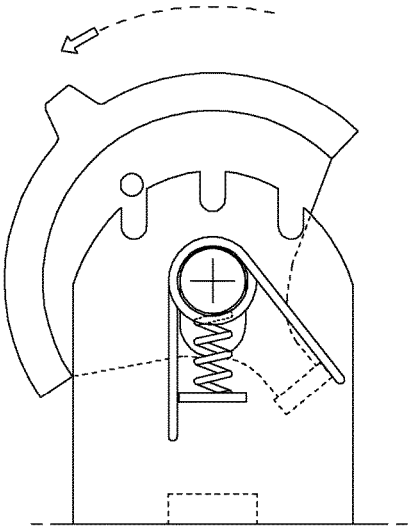
FIG. 5*c* is a side view of the second user control at a maximum angle and the depressed position.
Figure 5D:
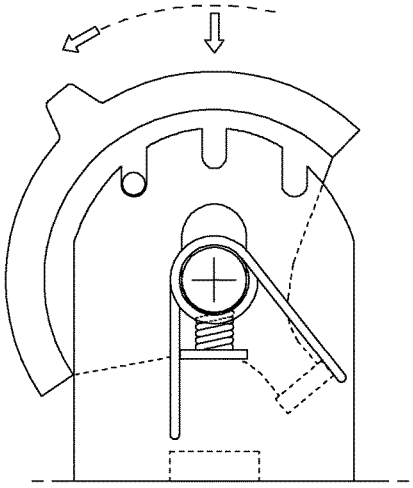
FIG. 5*d* is a side view of the second user control at an angle between the neutral angle and the maximum angle and the neutral position.

The arrangement of the first spring 438 allows the cap 120 to be linearly displaced relative to the base 226, with the pins 128 traveling downward in the slots, against the resistance of the spring 438 being compressed by such linear displacement. Upon removal of the external downward force on the cap 120, the force exerted by the spring 438 in the upward direction will tend to return the cap 120 to its neutral linear displacement. The spring 438 will exert this force even when the cap 120 is rotated away from the neutral rotation, as is shown in FIG. 5*c* and FIG. 5*d*.

The arrangement of the second spring 440 allows the cap 120 to be rotationally displaced relative to the base 226, with the pins 128 rotating within the slots 130 against the resistance of the rotated fourth spring 440. Specifically, as the cap 120 rotates, the magnet 134 rotates away from its centered position and thereby displaces one of the two legs, for example the second leg 448 as shown in FIG. 5*c*. The rotation of the cap 120 displaces the second leg 448 relative to the first leg 446, thereby rotating the coils 444 of the fourth spring 440 and generating a force against the magnet 134 which opposes further rotation of the cap 120. Upon removal of the external force rotating the cap 120, the force exerted by the fourth spring 440 on the cap 120 (which may resolve into a net torque on the cap 120) will tend to return the cap 120 to the neutral angle. In alternative embodiments, the first leg 446 and the second leg 448 may not press against opposite sides of the magnet 134, but may instead press against opposite sides of a portion of the cap 120.

While the disclosure has been illustrated and described in detail in the drawings and foregoing description, such illustration and description is not restrictive in character, it being understood that illustrative embodiment(s) have been shown and described and that all changes and modifications that come within the spirit of the disclosure are desired to be protected. Alternative embodiments of the present disclosure may not include all of the features described yet still benefit from at least some of the advantages of such features. Those of ordinary skill in the art may devise their own implementations that incorporate one or more of the features of the present disclosure and fall within the spirit and scope of the appended claims.

What is claimed is:

1. A user actuated control comprising:

a base;

a roller movably connected to the base so as to allow rotational displacement between a neutral angle and a maximum angle and linear displacement between a neutral position and a depressed position;

a magnet connected to the roller, the magnet positioned to rotate with rotational displacement of the roller, the magnet positioned to linearly displace with linear displacement of the roller;

a sensor connected to the base, the sensor configured to measure both the orientation and intensity of a magnetic field produced by the magnet and passing through the sensor;

a spring assembly connected to the roller and the base, the spring assembly configured to exert a torque on the roller in the direction of the neutral angle when the roller is rotationally displaced from the neutral angle, the spring assembly configured to exert a force on the roller in the direction of the neutral position when the roller is linearly displaced from the neutral position; and a shield positioned under the roller;

wherein:

the roller is movably connected to the base so as to allow rotational displacement between a minimum angle and the neutral angle, the neutral angle positioned between the minimum angle and the maximum angle; and the shield is configured to allow linear displacement of the roller to the depressed position when the roller is at the neutral angle, the shield is configured to block linear displacement of the roller to the depressed position at a first angle of the roller, the shield is configured to block linear displacement of the roller to the depressed position at a second angle of the roller, the first angle is between the maximum angle and the neutral angle, and the second angle is between the neutral angle and the minimum angle.

2. The control of claim 1, wherein the shield is configured to allow linear displacement of the roller to the depressed position when the roller is at the maximum angle and the shield is configured to allow linear displacement of the roller to the depressed position when the roller is at the minimum angle.

3. A user actuated control comprising:

a base;

a roller positioned above the base and pivotally and slidably connected to the base about a pin disposed in a slot having a slot length;

a top stop positioned to block further linear displacement of the roller in a first linear direction when the roller is at a neutral position;

a bottom stop positioned to block further linear displacement of the roller in a second linear direction opposite the first linear direction when the roller is at a depressed position;

a front stop positioned to block further rotational displacement of the roller in a first rotational direction when the roller is at a maximum angle;

a rear stop positioned to block further rotational displacement of the roller in a second rotational direction opposite the first rotational direction when the roller is at a minimum angle;

a magnet connected to the roller, the magnet positioned to rotate with rotational displacement of the roller, the magnet positioned to linearly displace with linear displacement of the roller;

a sensor connected to the base, the sensor configured to measure both the orientation and intensity of a magnetic field produced by the magnet and passing through the sensor; and a spring assembly connected to the roller and the base, the spring assembly positioned to exert force on the roller in the first linear direction when the roller is at the depressed position, the spring assembly positioned to exert torque on the roller in the first rotational direction when the roller at the minimum angle, the spring assembly positioned to exert torque on the roller in the second rotational direction when the roller is at the maximum angle.

4. The control of claim 3, wherein the top stop is a portion of the slot at a first end of the slot in the direction of the slot length where the pin contacts the slot when the roller is at the neutral position and the bottom stop is a portion of the slot at a second end of the slot opposite the first end of the slot in the direction of the slot length where the pin contacts the slot when the roller is at the depressed position.

5. The control of claim 3, wherein the top stop is a portion of the slot at an end of the slot in the direction of the slot length where the pin contacts the slot when the roller is at the neutral position and the bottom stop is a portion of the base which contacts the roller when the roller is at the depressed position.

6. The control of claim 3, wherein the spring assembly is positioned to exert a first force on the roller in the first linear direction when the roller is at the depressed position, the spring assembly is positioned to exert the equivalent of a second force on a surface of the roller tangent to the surface in the first rotational direction when the roller is at the minimum angle, the spring assembly is positioned to exert the equivalent of a third force on the surface of the roller tangent to the surface in the second rotational direction when the roller is at the maximum angle, and the magnitude of the first force is greater than the magnitude of the second force and greater than the magnitude of the third force.

7. The control of claim 3, further comprising a shield positioned between the base and the roller, wherein the shield comprises a hole, the roller comprises a protrusion, and the protrusion is positioned within the hole when the roller is at the depressed position and the neutral angle.

8. The control of claim 3, further comprising a shield positioned between the base and the roller, wherein the shield comprises a first hole, a second hole, and a third hole, the roller comprises a protrusion, the protrusion is positioned within the first hole when the roller is at the depressed position and the neutral angle, the protrusion is positioned within the second hole when the roller is at the depressed position and the maximum angle, and the protrusion is positioned within the third hole when the roller is at the depressed position and the minimum angle.

9. The control of claim 3, wherein the sensor is a Hall Effect sensor.

10. The control of claim 3, wherein the sensor is configured to provide a rotation signal indicative of the rotational displacement of the roller based on the measured orientation of the magnetic field, and to provide a displacement signal indicative of the linear displacement of the roller based on the measured intensity of the magnetic field.

11. The control of claim 10, where the displacement signal is binary such that it indicates the roller is not depressed unless the measured intensity of the magnetic field is greater than a threshold, in which case it indicates that the roller is depressed.

* * * * *